US011072408B1

(12) United States Patent
Kurzynski et al.

(10) Patent No.: US 11,072,408 B1
(45) Date of Patent: Jul. 27, 2021

(54) MARINE ENGINES AND COOLING SYSTEMS FOR COOLING LUBRICANT IN A CRANKCASE OF A MARINE ENGINE

(71) Applicant: Brunswick Corporation, Mettawa, IL (US)

(72) Inventors: Adam J. Kurzynski, Neenah, WI (US); Chetan A. Dharmadhikari, North Fond du Lac, WI (US); Barry P. Schleicher, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 16/564,856

(22) Filed: Sep. 9, 2019

(51) Int. Cl.
*B63H 20/28* (2006.01)
*F01P 3/20* (2006.01)
*B63H 20/32* (2006.01)

(52) U.S. Cl.
CPC ..... *B63H 20/28* (2013.01); *F01P 3/202* (2013.01); *B63H 2020/323* (2013.01)

(58) Field of Classification Search
CPC .. B63H 20/28; B63H 2020/323; B63H 21/26; B63H 21/28; B63H 21/265; F01P 3/202
See application file for complete search history.

(56) References Cited

U.S. PATENT DOCUMENTS 2,656,825 A 10/1953 Hartz
3,918,418 A * 11/1975 Horn ..... B63H 20/28 123/41.08
5,109,809 A * 5/1992 Fujimoto ..... F01P 3/202 123/41.08
5,876,256 A 3/1999 Takahashi et al.
5,937,801 A 8/1999 Davis
6,012,956 A 1/2000 Mishima et al.
6,059,619 A 5/2000 Nozue
6,540,573 B2 4/2003 Sato
6,733,352 B1 5/2004 Belter et al.
7,806,740 B1 10/2010 Taylor et al.
8,696,394 B1 * 4/2014 Langenfeld ..... F01P 3/202 440/880
9,365,274 B1 6/2016 George et al.
9,403,588 B1 8/2016 George et al.
9,457,881 B1 10/2016 Belter et al.
9,616,987 B1 4/2017 Langenfeld et al.
10,047,661 B1 8/2018 Torgerud
10,233,818 B1 3/2019 Reichardt et al.
10,239,598 B2 3/2019 Jaszewski
10,318,423 B2 6/2019 Liu
10,344,639 B1 7/2019 Nickols et al.
10,800,502 B1 10/2020 Alby et al.
10,858,974 B1 12/2020 Hoffman et al.
(Continued)

OTHER PUBLICATIONS

Hoffman et al., unpublished U.S. Appl. No. 16/128,719, filed Sep. 12, 2018.

*Primary Examiner* — Anthony D Wiest
(74) *Attorney, Agent, or Firm* — Andrus Intellectual Property Law, LLP

(57) ABSTRACT

A marine engine has a powerhead, a crankcase and a crankshaft disposed in the crankcase. A cooling system has a cooling passage that conveys cooling water for cooling the crankcase, a pump that pumps the cooling water from a body of water in which the marine engine is operated through the cooling passage, and a valve that controls discharge of the cooling water from the cooling passage.

19 Claims, 11 Drawing Sheets

(56) References Cited

U.S. PATENT DOCUMENTS

| | | | | |
|---|---|---|---|---|
| 2001/0039156 | A1* | 11/2001 | Sato | F01P 3/202<br>440/88 A |
| 2002/0088425 | A1* | 7/2002 | Westerbeke, Jr. | F02B 75/007<br>123/196 R |
| 2013/0273792 | A1* | 10/2013 | Davis | B63H 20/002<br>440/75 |
| 2017/0328265 | A1 | 11/2017 | George et al. | |
| 2018/0251202 | A1 | 9/2018 | Saruwatari et al. | |

* cited by examiner

MARINE ENGINES AND COOLING SYSTEMS FOR COOLING LUBRICANT IN A CRANKCASE OF A MARINE ENGINE

FIELD

The present disclosure generally relates to marine engines, for example outboard marine engines having a crankcase and cooling systems for cooling lubricant in the crankcase.

BACKGROUND

The following U.S. patents and patent applications are incorporated herein by reference in entirety:

U.S. Pat. No. 10,239,598 discloses an outboard motor having an internal combustion engine that causes rotation of a driveshaft, a planetary transmission that operatively connects the driveshaft to a transmission output shaft, a band brake configured to shift the planetary transmission amongst a forward gear, neutral gear and reverse gear, a hydraulic actuator configured to actuate the band brake, and a cooling water circuit that extends adjacent to the hydraulic actuator so that the hydraulic actuator exchanges heat with cooling water in the cooling water circuit.

U.S. Pat. No. 10,233,818 discloses a marine propulsion device having an internal combustion engine; an axially elongated exhaust conduit that conveys exhaust gas from the upstream internal combustion engine to a downstream outlet; a cooling water sprayer that is configured to spray a flow of cooling water radially outwardly toward an inner diameter of the axially elongated exhaust conduit; a temperature sensor located downstream of the cooling water sprayer and configured to sense temperature of the exhaust gas and cooling water; and a controller configured to identify a fault condition associated with the cooling water sprayer based on the temperature of the exhaust gas and cooling water.

U.S. Pat. No. 9,616,987 discloses an outboard motor and a method of making an outboard motor, which provide an exhaust conduit having a first end that receives exhaust gas from an internal combustion engine and a second end that discharges exhaust gas to seawater via a propeller shaft housing outlet. An exhaust conduit opening is formed in the exhaust conduit between the first and second ends. The exhaust conduit opening is for discharging exhaust gas from the exhaust conduit to atmosphere via a driveshaft housing of the outboard motor and via an idle exhaust relief outlet and a driveshaft housing outlet in the driveshaft housing. The driveshaft housing outlet is located between the propeller shaft housing outlet and the idle exhaust relief outlet. A cooling pump pumps cooling water from a cooling water inlet for cooling the internal combustion engine to a cooling water outlet for discharging cooling water from the outboard motor. The exhaust conduit opening and cooling water outlet are configured such that the cooling water collects by gravity in the driveshaft housing to a level that is above the exhaust conduit opening.

U.S. Pat. No. 9,457,881 discloses an outboard marine engine having an engine block; a crankcase on the engine block; a crankshaft disposed in the crankcase for rotation about a crankshaft axis; a cover on the crankcase; a bedplate disposed between the engine block and the cover. The bedplate has a plurality of bearings for supporting rotation of the crankshaft. A cooling water jacket extends parallel to the crankshaft axis along a radially outer portion of the plurality of bearings. The cooling water jacket carries cooling water for cooling the plurality of bearings and at least one oil drain-back area is located adjacent to the cooling water jacket. The oil drain-back area drains oil from the crankcase.

U.S. Pat. No. 9,403,588 discloses systems for cooling a marine engine that is operated in a body of water. The systems can include an open loop cooling circuit for cooling the marine engine, wherein the open loop cooling circuit is configured to convey cooling water from the body of water to the marine engine so that heat is exchanged between the cooling water and the marine engine, and a pump that is configured to pump the cooling water from upstream to downstream through the open loop cooling circuit. A heat exchanger is configured to cause an exchange of heat between the cooling water located upstream of the marine engine and the cooling water located downstream of the marine engine to thereby warm the cooling water located upstream of the marine engine, prior to cooling the marine engine.

U.S. Pat. No. 9,365,274 discloses an outboard marine propulsion device having an internal combustion engine having a cylinder head and a cylinder block and an exhaust manifold that discharges exhaust gases from the engine towards a vertically elongated exhaust tube. The exhaust manifold has a plurality of inlet runners that receive the exhaust gases from the engine, and a vertically extending collecting passage that conveys the exhaust gases from the plurality of inlet runners upwardly to a bend that redirects the exhaust gases downwardly towards the exhaust tube. A cooling water jacket is on the exhaust manifold and conveys cooling water alongside the exhaust manifold. A catalyst housing is coupled to the exhaust manifold and a cooling water jacket is on the catalyst housing and carries cooling water alongside the catalyst housing. A catalyst is disposed in the catalyst housing.

U.S. Patent Publication No. 2017/0328265 discloses an open loop cooling water system for a marine engine. A cooling water inlet receives cooling water from a body of water. A cooling water outlet discharges the cooling water back to the body of water. A cooling water circuit conveys cooling water from the cooling water inlet, through the marine engine, and to the cooling water outlet. A cooling water pump pumps cooling water from upstream to downstream through the cooling water circuit. A recirculation pump is located in the cooling water circuit downstream of at least one component of the marine engine and upstream of the cooling water outlet. The recirculation pump is configured to pump cooling water from downstream of the marine engine back into the cooling water circuit upstream of the marine engine. Methods are for cooling a marine engine using an open loop cooling system.

U.S. patent application Ser. No. 16/128,719 discloses an exhaust manifold for an outboard motor having an internal combustion engine. The exhaust manifold has an exhaust conduit that conveys exhaust gas from the internal combustion, and a cooling jacket on the exhaust conduit. The cooling jacket defines a first cooling water passage that conveys cooling water in a first direction alongside the exhaust conduit, a second cooling water passage that conveys the cooling water from the first cooling water passage in an opposite, second direction alongside the exhaust conduit, and third cooling water passage that is separate from the first and second cooling water passages and conveys spent cooling water from the internal combustion engine to a thermostat.

U.S. Pat. No. 10,344,639 discloses a marine engine having a crankcase with a crankshaft that rotates about a vertical crankshaft axis; a cover on the crankcase; and a cooling member disposed in the crankcase. The cooling member has an inner surface that faces the crankshaft and an outer surface that faces the cover. The cooling member is configured such that rotation of the crankshaft causes lubricant in the crankcase to impinge on and drain down both the inner and outer surfaces of the cooling member.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter. In certain examples disclosed herein, a marine engine has a powerhead, a crankcase and a crankshaft disposed in the crankcase. A cooling system has a cooling passage that conveys cooling water for cooling the crankcase, a pump that pumps the cooling water from a body of water in which the marine engine is operated through the cooling passage, and a valve that controls discharge of the cooling water from the cooling passage.

BRIEF DESCRIPTION OF THE DRAWINGS

Examples of marine engines and cooling systems for marine engines are described with reference to the following drawing figures. The same numbers are used throughout to reference like features and components.

DETAILED DESCRIPTION OF THE DRAWINGS

Through research and experimentation, the present inventors have determined that prior art marine engines fail to meet a need for restriction of cooling water flow through the engine crankcase when the marine engine is operated in cold water conditions. Thus the prior art often fails to achieve optimal operating conditions for open loop cooling water systems. In particular, in cooling water systems that utilize water from the surrounding body of water in which the marine vessel operates, such as disclosed in U.S. Patent Application Publication No. 2017/0328265, the temperature of the body of water often dictates the temperature of cooling water entering the marine engine. This can be problematic in colder conditions, wherein one of the first components cooled in the system is likely to be overcooled, which can result in one or more of the following problematic issues: exhaust condensation in the exhaust manifold, oil condensation, exhaust condensation in the cylinder head, fuel dilution in the cylinder head and/or fuel dilution in the cylinder block. The present inventors have determined that prior art cooling systems that provide an uncontrolled supply of cooling water to the engine crankcase are susceptible to such overcooling, which can result the above-mentioned negative outcomes. The present inventors have realized a need to overcome these disadvantages.

Figure 1:
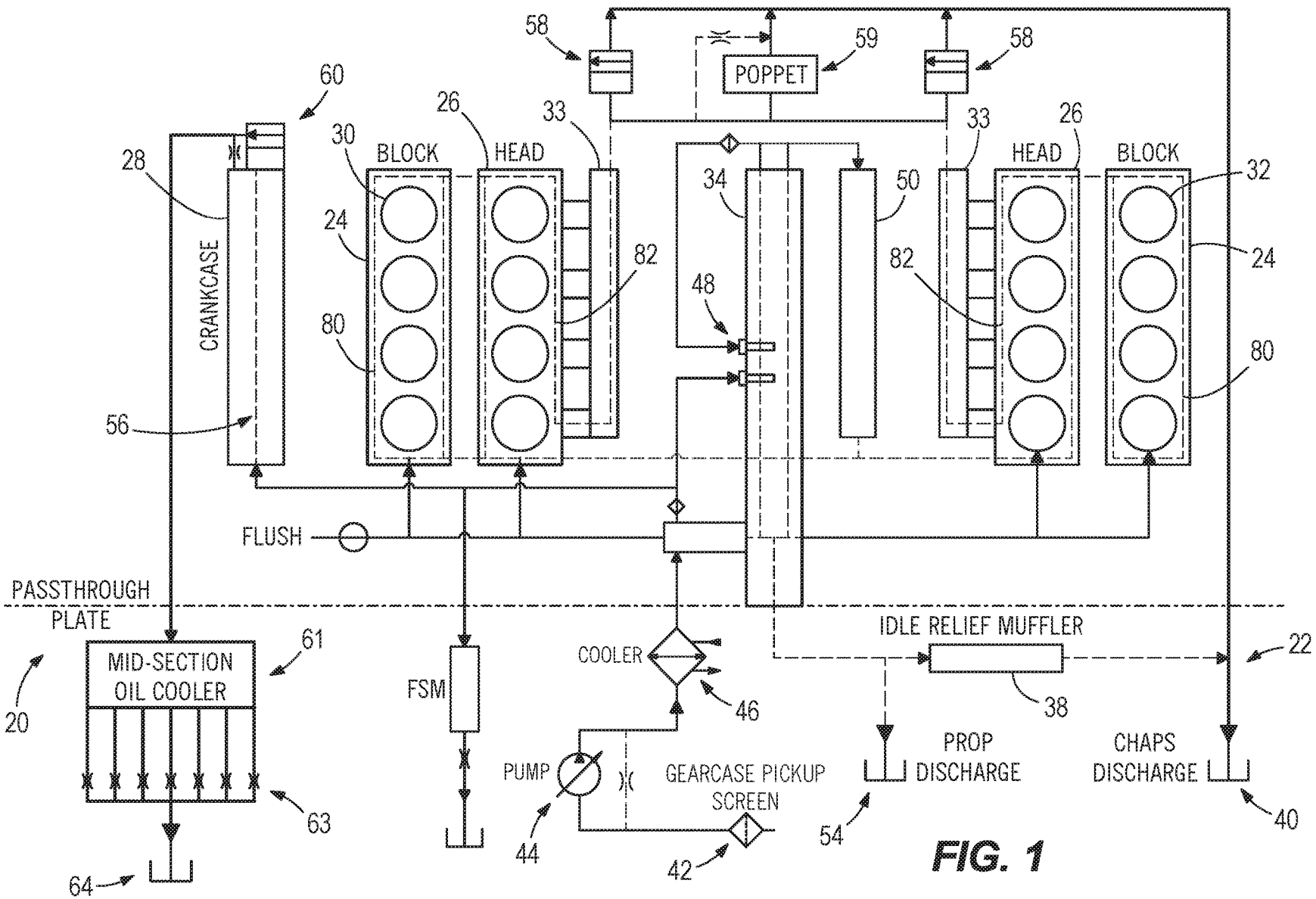
FIG. 1 is a schematic view of a first embodiment of a cooling system for a marine engine according to the present disclosure.

FIG. 1 schematically depicts a first example of a marine engine 20 according to the present disclosure. The marine engine 20 is for use in an outboard motor, although the concepts of the present disclosure are not limited for use with outboard motors, and can for example be used with marine generators. The marine engine 20 has a cooling system 22 for cooling various components of the marine engine 20. The marine engine 20 has a powerhead including among other things an engine block 24 and engine heads 26. A crankcase 28 contains a crankshaft (not shown). In a non-limiting example, the marine engine 20 is configured like the embodiments disclosed in U.S. Pat. No. 9,616,987, wherein the engine block 24 has first and second banks of cylinders 30, 32 that are disposed along a common crankshaft axis C (see FIG. 9) and extend transversely with respect to each other in a V-shape so as to define a valley there between. An exhaust conduit 34 conveys exhaust gas from the marine engine 20 for discharge to atmosphere. The exhaust conduit 34 is centrally located in the valley and receives the exhaust gas from the first and second banks of cylinders 30, 32 via exhaust manifolds 33 on the engine heads 26. Via these and other components, the marine engine 20 discharges the exhaust gas to an underwater outlet (not shown), typically formed through the noted propeller and optionally, alternately to atmosphere during certain operational states of the marine engine, for example during operation at idle speeds, via an idle relief muffler 38 and an idle relief outlet 40 located for example though a cowling of the outboard motor. The combustion process in the marine engine 20 causes rotation of the noted crankshaft, which in turn causes rotation of a corresponding driveshaft, propeller shaft, and propeller configured to propel a marine vessel in water, all as is conventional. The above-incorporated U.S. Pat. No. 9,616,987 discloses examples of type of arrangement in more detail.

The cooling system 22 includes several conduits (shown in solid lines) and passages (shown in dashed lines) for conveying cooling water from the body of water in which the outboard motor is operating to the marine engine 20 for cooling various components thereof, and then back to the body of water. The cooling system 22 includes an underwater inlet 42 which is located on a lower gearcase of the outboard motor or any other location that is under water during normal operation of the outboard motor. A conventional mechanical or electric pump 44 is configured to draw the cooling water into the outboard motor via the underwater inlet 42, through a screen and/or similar filtering apparatus. The pump 44 is configured to pump the cooling water through a series of cooling conduits and/or passages, including hoses, cooling jackets, and/or lines. The cooling water is initially conveyed to a transmission cooler 46, which can be configured for example as disclosed in U.S. Pat. No. 10,239, 598, for cooling a transmission associated with the outboard motor. The cooling system 22 further conveys the cooling water upwardly into and alongside the exhaust conduit 34. In particular, the cooling water is conveyed through a cooling jacket on the exhaust conduit 34 and a portion of the cooling water is sprayed into the exhaust gas conveyed through the exhaust conduit 34 via cooling water sprayers 48, all as is disclosed for example in U.S. Pat. No. 10,233,818.

From the cooling jacket on the exhaust conduit 34, the cooling water is conveyed through a lubricant cooler 50 located in the noted valley of the marine engine 20, which particularly is located between the exhaust conduit 34 and the engine block 24, for example as disclosed in U.S. patent application Ser. No. 16/128,719. From the lubricant cooler 50, the cooling water is conveyed to cooling passages 80, 82 in the engine heads 26 and engine block 24, for example as is disclosed U.S. Pat. No. 9,365,274. From the engine heads 26, the cooling water is conveyed upwardly through cooling jackets on exhaust manifolds 33 that convey the exhaust gas from the engine heads 26 to the exhaust conduit 34. Valves 58 are mounted on the exhaust manifolds 33, for example as disclosed in U.S. Pat. No. 10,318,423, and are configured to control discharge of the cooling water from the cooling system 22 based on the temperature of the cooling water and/or the marine engine 20. The valves 58 can be conventional thermostats available for commercial purchase from Mercury Marine of Fond du Lac, Wis., for example part number 892864T04. A poppet valve 59 is also mounted on the powerhead and configured to control discharge of the cooling water based on pressure. The poppet valve 59 can be a conventional item available for commercial purchase from Mercury Marine of Fond du Lac, Wis., for example part number 40820014U. The spent cooling water is discharged for example to an underwater outlet 54, located for example on the lower gearcase of the outboard motor.

The cooling system 22 also conveys the cooling water to the crankcase 28 and then through a cooling passage 56 in the crankcase 28, particularly for cooling the crankcase 28 and particularly for cooling lubricant (e.g., oil) contained within the crankcase 28. Conveyance means for the cooling water is shown via solid lines representing conduits such as for example hoses/tubes and dashed lines representing passages such as defined by a cooling jacket. In the first embodiment, the cooling water is conveyed from the pump 44 to a cooling passage 56 in the crankcase 28 without being first provided to the above-described cooling passages 80, 82 in the engine block 24 and engine head 26. Other embodiments that differ in this regard are described herein below and shown in the other figures. Thus, according to the first embodiment, the cooling water is conveyed in parallel through the cooling passage 56 in the crankcase 28 and cooling passages 80, 82 in the engine block 24 and engine head 26. The type and configuration of the cooling passage 56 can vary. In certain examples, the cooling passage 56 is defined by a cooling jacket 124 (see FIG. 10) on the crankcase 28, for example on a removable cover 122 on the crankcase 28, for example as disclosed in U.S. Pat. No. 9,457,881. In other examples, the cooling passage 56 is defined by a cooling member (not shown) located inside of the crankcase 28, for example as disclosed in U.S. Pat. No. 10,344,639.

According to the present disclosure, a valve 60 controls discharge of the cooling water from the cooling system 22 and particularly from the cooling passage 56 in the crankcase. According to the first embodiment shown in FIG. 1, the valve 60 is a thermostat mounted on or near the top of the crankcase 28. The valve 60 is configured to automatically prevent most or all of the flow of the cooling water from the cooling system and particularly from the cooling passage 56 in the crankcase 28 based on temperature of the cooling water, and alternately to automatically allow most or all of the flow of the cooling water from the cooling system 22 and particularly from the cooling passage 56 in the crankcase 28 based on temperature of the cooling water. It is recognized that many conventional thermostats allow at least some flow of the cooling water in all conditions, so the terms "open" and "closed" are relative and not absolute terms when used to describe the position of the valve 60. Note that as shown in FIG. 1, there are no other outlets for the cooling water in the cooling passage 56, i.e., so that all the cooling water in the cooling passage 56 must flow through the valve 60. The thermostat can be a conventional item available for commercial purchase from Mercury Marine of Fond du Lac, Wis., for example part number 892864T04. The temperature at which the valve 60 is configured to open/close can vary. In one example, the valve 60 is configured to open at a temperature of fifty-two degrees C. In certain examples, the valve 60 can also be configured to purge air from the cooling system 22 and particularly from the cooling passage 56 in the crankcase 28. The air purge capability is provided in the above-referenced Mercury Marine part. The air purge capability of the valve 60 can be internal or external to the thermostat. In particular, the valve 60 can have an air bleed which is located at the interface between the valve plate and housing in the form of a notch. The notch can be incorporated into the valve, the housing, or both. But, it can also be defined as a separate passage from the thermostat. This air bleed allows flow from the inlet side of the valve/poppet to the outlet side. The air bleed (hole or passage) will be at the same height as the thermostat valve/poppet in order to allow air to escape from the cooling system during startup. Post startup, water will be flowing through this passage once all the air has escaped. In the illustrated example, the valve 60 discharges the cooling water from the cooling passage 56 further to a lubricant sump cooler 61 (e.g., cooling shower) for cooling a lubricant sump 63 containing lubricant for the powerhead. The cooling system 22 then discharges the cooling water back to the body of water in which the marine engine 20 is operated via the noted discharge outlet 64, which can be located for example on the noted lower gearcase of the outboard motor.

Figure 2:
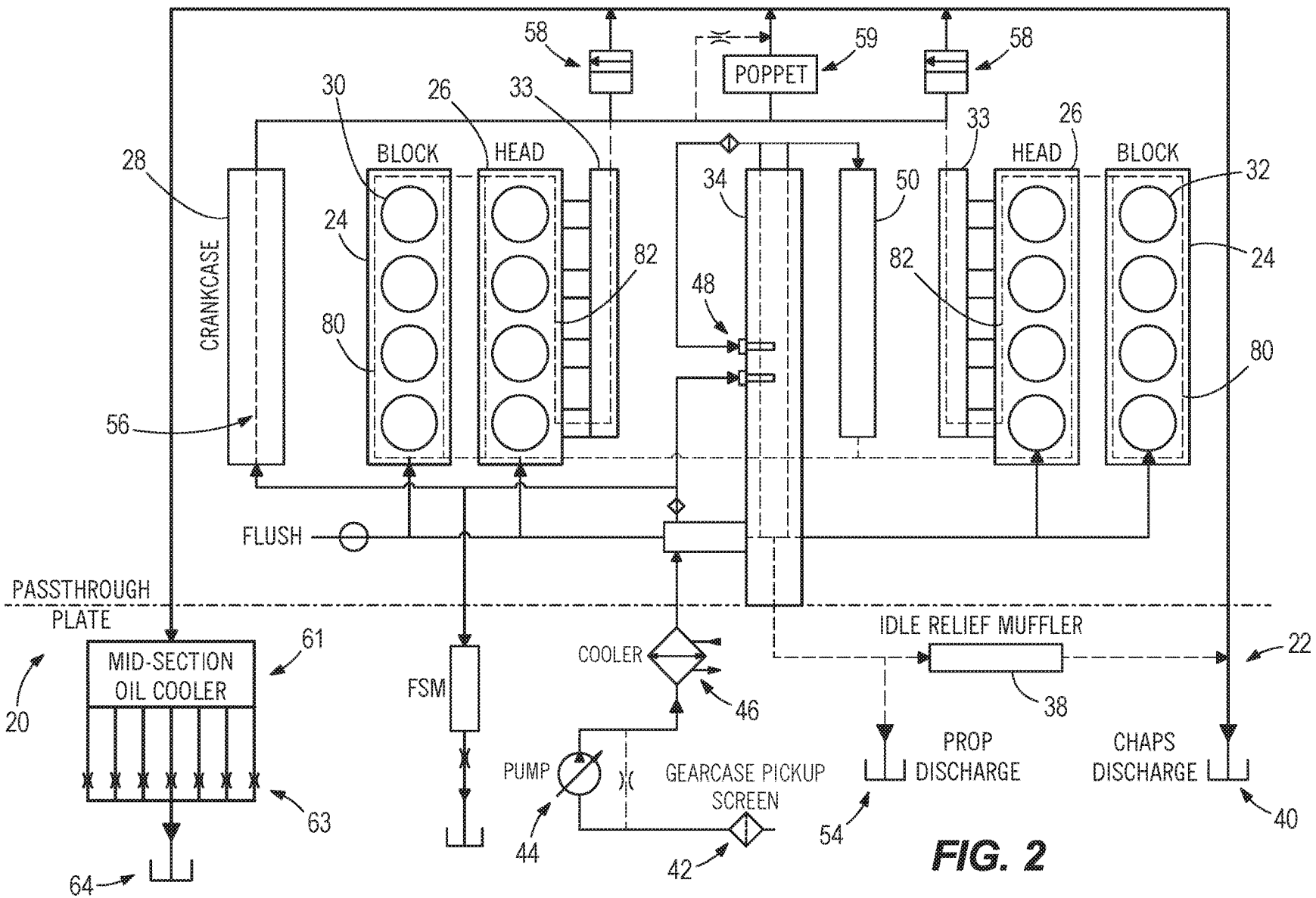
FIG. 2 is a schematic view of a second embodiment of the cooling system.

FIG. 2 schematically depicts a second embodiment, which differs from the first embodiment in that the cooling system 22 omits the valve 60. Instead the cooling system 22 conveys the cooling water from the cooling passage 56 in the crankcase 28 to the inlet side of the valves 58 and 59, which as described herein above are mounted on the exhaust manifolds 33 and powerhead, respectively. Note that there are no other outlets for the cooling water in the cooling passage 56, so all the cooling water from the cooling passage 56 must flow through the valves 58 and 59. Thus the valves 58 and 59 replace (i.e., perform the function of) the above-described valve 60, controlling discharge of the cooling water from the cooling passage 56 in the crankcase 28. The valves 58 and 59 also control discharge of the cooling water from the engine block 24 and engine heads 26, which is combined together with the cooling water from the crankcase 28 at a location upstream of the valves 58, 59 and downstream of the engine block 24 and engine heads 26, as shown in FIG. 2.

Figure 3:
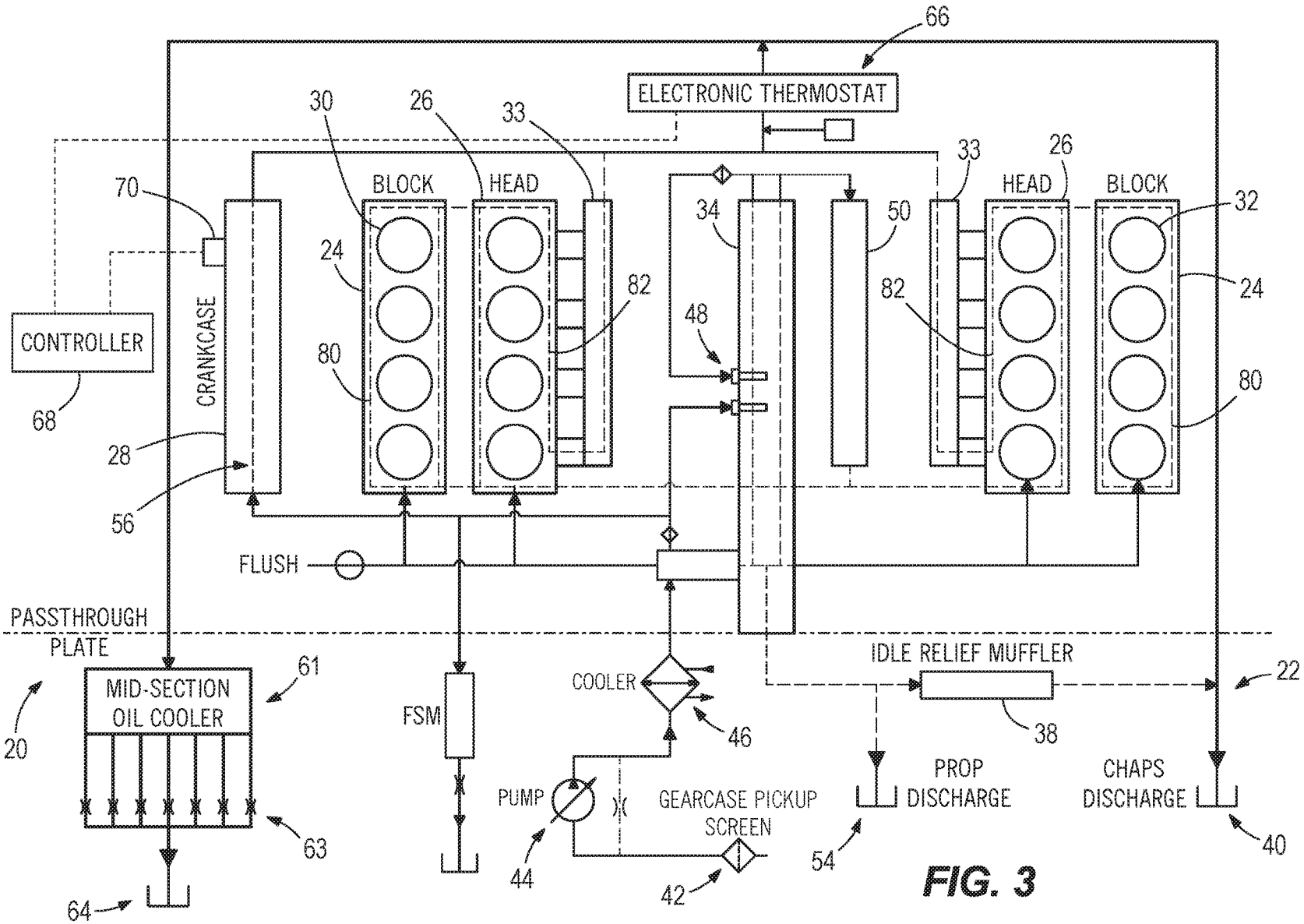
FIG. 3 is a schematic view of a third embodiment of the cooling system.

FIG. 3 schematically depicts a third embodiment, which differs from the first and second embodiments in that the cooling system 22 omits the valves 58, 59, 60. Instead, the cooling system 22 has an electronic thermostat 66 that is controlled by a controller 68 (e.g., engine control unit, computer controller). The controller 68 may include computing systems having processing systems, memory systems, executable programs, and input/output (I/O) systems for communicating with other devices. The processing systems load and execute the executable programs from the memory systems, which direct the system to operate as described herein. The processing systems may be implemented as a single microprocessor or other circuitry, or be distributed across multiple processing devices or sub-systems that cooperate to execute the executable programs from the memory systems. Non-limiting examples of the processing systems include general purpose central processing units, applications specific processors, and logic devices. The memory system may comprise any storage media readable by the processing system and capable of storing executable program. The memory system may also store data, such as the temperature data and the like. The memory system may be implemented as a single storage device, or be distributed across multiple storage devices or sub-systems that cooperate to store computer readable instructions, data structures, program modules, or other data. The memory system may include volatile and/or non-volatile systems, and may include removable and/or non-removable media implemented in any method or technology for storage of information.

In this example, the cooling system 22 conveys the cooling water from the cooling passage 56 in the crankcase 28 to the inlet side of the electronic thermostat 66, which is mounted on the powerhead, for example on the engine block 24 or engine heads 26. Note that there are no other outlets for the cooling water in the cooling passage 56, so all the cooling water in the cooling passage 56 must flow through the electronic thermostat 66. The electronic thermostat 66 can be a conventional item available for commercial purchase from Mercury Marine of Fond du Lac, Wis. A suitable example is described in U.S. Pat. No. 6,733,352, which is hereby incorporated herein by reference. The controller 68 is programmed to control opening and closing of the thermostat 66 based upon input from a temperature sensor 70 associated with the marine engine, including for example a temperature sensor 70 that provides the input based upon temperature of at least one of temperature of the crankcase 28, the cooling water, the engine lubricant, the exhaust gas discharged from the marine engine 20, and/or the like. In the illustrated example, the temperature sensor 70 is mounted on the crankcase 28 and is configured to sense the temperature of the crankcase 28 and/or lubricant in the crankcase 28 and communicates this information to the controller 68 via a wired or wireless link. The controller 68 in turn communicates with and controls the electronic thermostat 66 via a wired or wireless link based upon the information sensed by the sensor 70.

Figure 4:
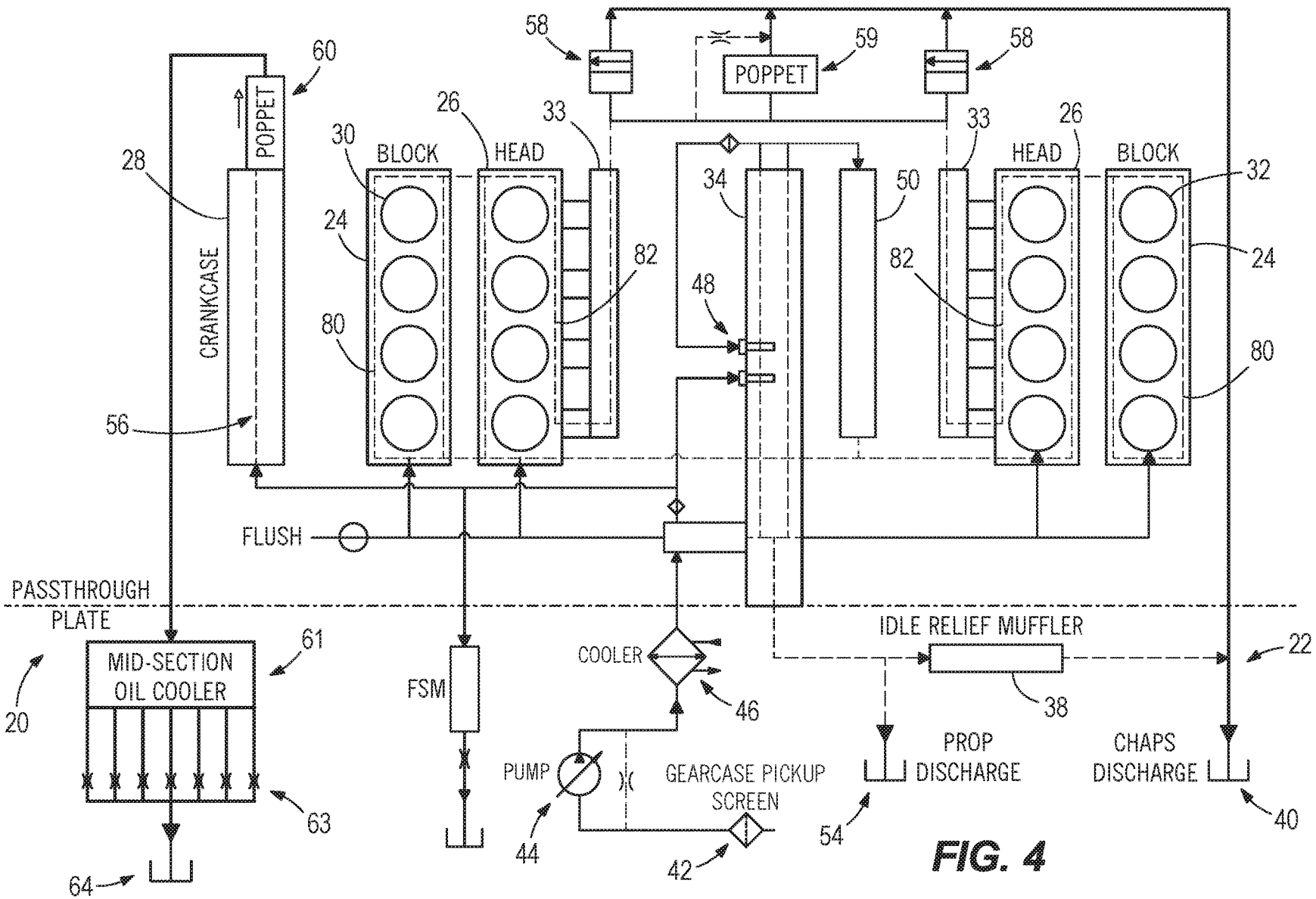
FIG. 4 is a schematic view of a fourth embodiment of the cooling system.

FIG. 4 schematically depicts a fourth embodiment, which differs from the first, second and third embodiments in that the valve 60 is a mechanical valve (e.g., poppet) that automatically opens and closes based upon pressure of the cooling water in the cooling system 22. Note that there are no other outlets for the cooling water in the cooling passage 56, so all the cooling water in the cooling passage 56 must flow through the valve 60. The valve 60 can be configured to restrict flow of the cooling water from the cooling passage 56 to the lubricant sump cooler 61 based upon pressures being above normal pressures when the marine engine 20 is operated at idle speed. The poppet can be a conventional item available for commercial purchase from Mercury Marine of Fond du Lac, Wis., for example part number 40820014U. Thus the valve 60 is configured to open as engine speed increase (which causes the cooling pump speed to increase, thus increasing fluid pressure). Similar to the first embodiment, the valve 60 is mounted on the crankcase 28. The valve 60 can be configured to purge air from the cooling passage 56. The air purge capability of the valve 60 can be internal or external to the poppet, as described above.

Figure 5:
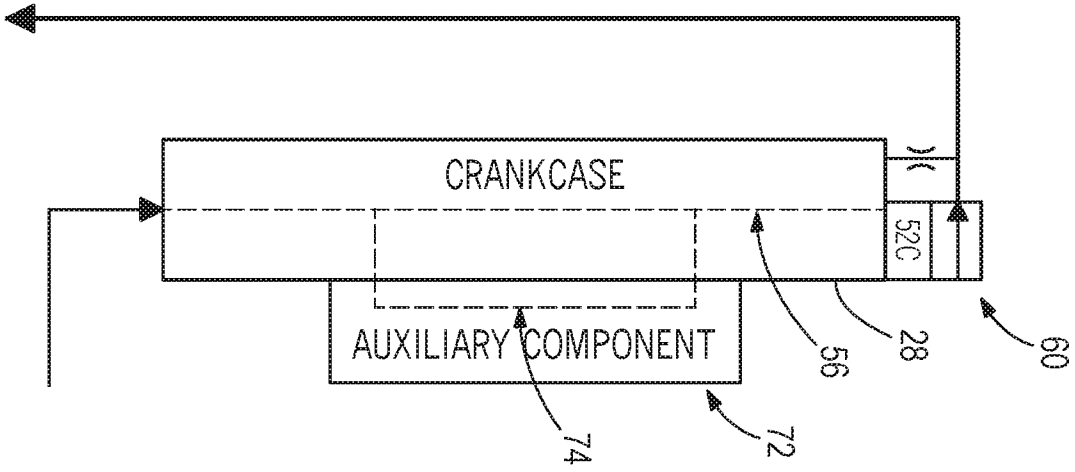
FIG. 5 is a schematic view of a first embodiment of an auxiliary component and cooling system combination.
Figure 6:
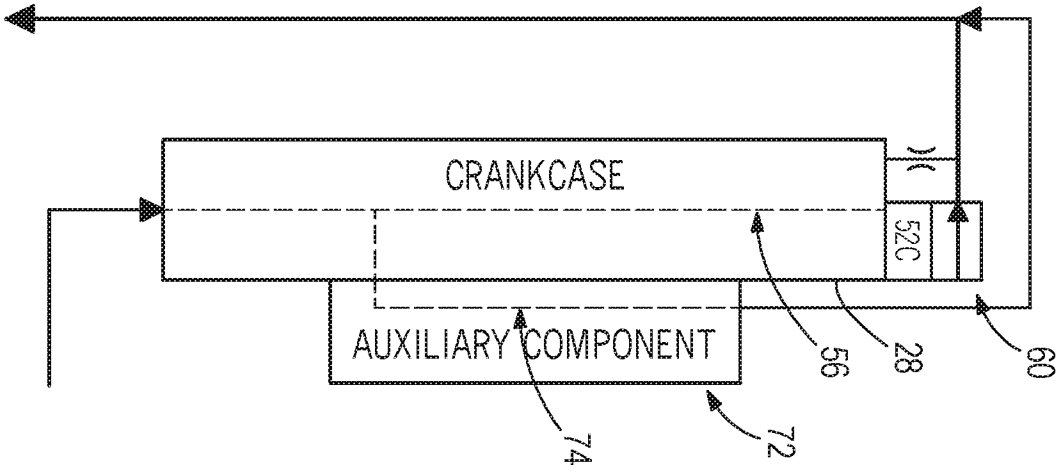
FIG. 6 is a schematic view of a second embodiment of the auxiliary component and cooling system combination.

Through further research and experimentation, the present inventors have realized an advantage of mounting or integrating one or more auxiliary components on the crankcase cover 122 and/or in thermal communication with the cooling water in the cooling passage 56 in the crankcase 28, which as described herein above is regulated by a valve 58, 59 and/or 60 including a thermostat, poppet, electronic thermostat, and/or the like. As shown in FIGS. 5 and 6, an auxiliary component 72 is mounted on the crankcase 28 and particularly adjacent to the cooling passage 56 in a location where the auxiliary component 72 exchanges heat with the cooling water in the cooling passage 56. The auxiliary component 72 can be for example a fuel cooler, a power steering fluid controller, a transmission fluid cooler, an engine control module, a trim relay module, a power steering module, and/or the like. A cooling passage 74 receives the cooling water from the cooling passage 56 through the crankcase 28. FIG. 5 depicts an example wherein all the cooling water from the cooling passage 74 in the auxiliary component 72 must flow through the valve 60. In particular, the cooling passage 74 receives the cooling water from the cooling passage 56, conveys the cooling water through the auxiliary component 72, and discharges the cooling water back to the cooling passage 56 upstream of the valve 60. FIG. 6 depicts an alternate example wherein discharge of the cooling water from the cooling passage 74 bypasses the valve 60. In certain examples, the present inventors have realized that it is also possible and often advantageous to add cooling fins (not shown) to the crankcase 28, adjacent to the cooling passage 56, to facilitate heat exchange during relatively hot operating conditions and with increased horsepower.

Through continued research and development, the present inventors have determined that prior art arrangements that lack the above-described valve 58, 59 and/or 60 for controlling flow of the cooling water through the crankcase 28 can reach crankcase lubricant temperatures of forty-four degrees C. or more when a supply of cooling water of twenty-five degrees C. or less is supplied. Adding the above-described valve 58, 59 and/or 60 configured to open at fifty-two degrees C. advantageously improved lubricant temperatures to sixty-five degrees C. at the same operating conditions. As stated in U.S. Patent Publication No. 2017/0328265, an exemplary preferred target temperature for eliminating condensation in the lubricant is fifty-two degrees C.

Figure 7:
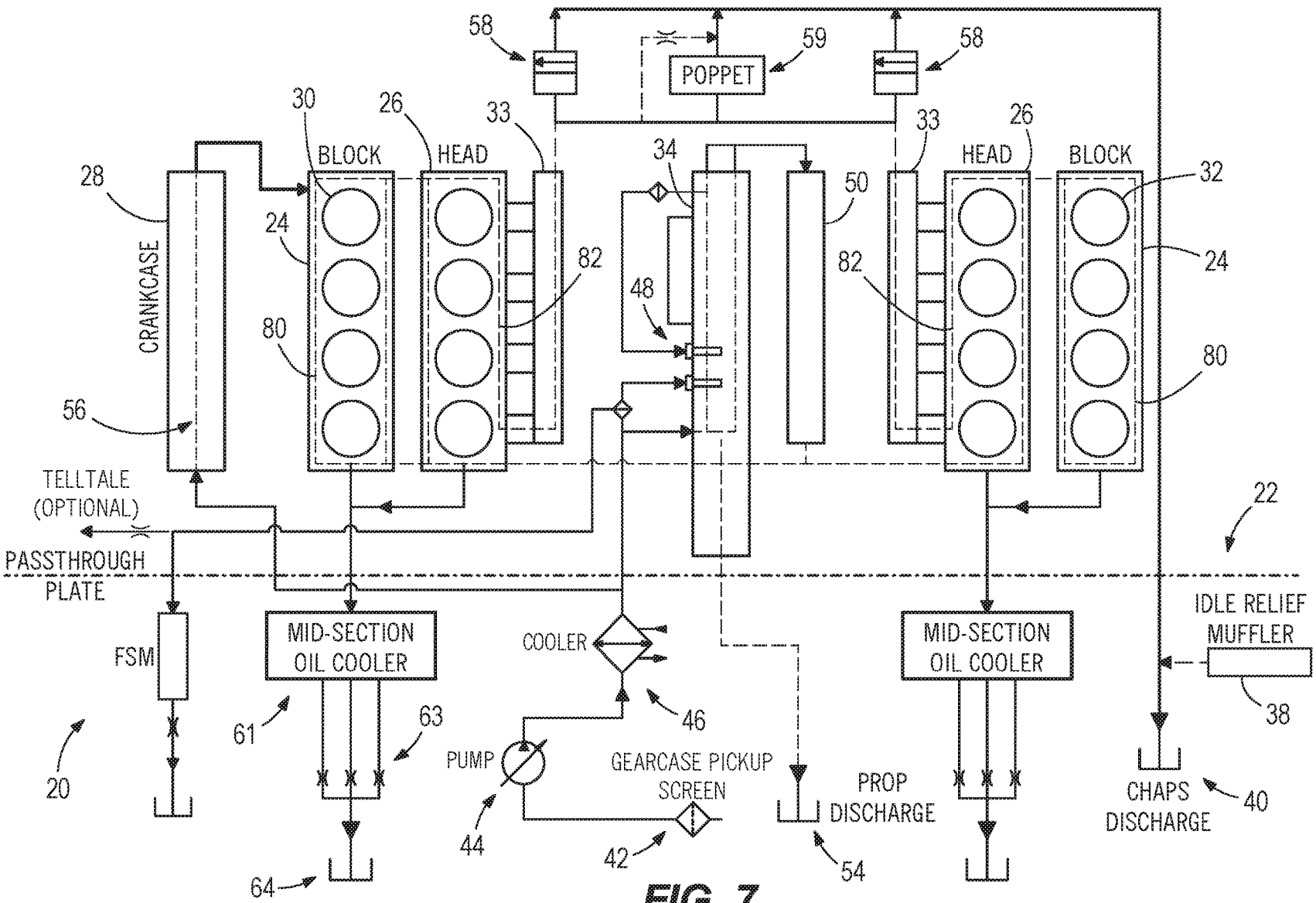
FIG. 7 is a schematic view of a fifth embodiment of the cooling system.

FIG. 7 schematically depicts a fifth embodiment which differs from the first-fourth embodiments in that the cooling system 22 conveys the cooling water from the cooling passage 56 in the crankcase 28 to the cooling passages 80, 82 in the engine block 24 and engine heads 26, and then to the inlet side of the valves 58 and 59. Note that there are no other outlets for the cooling water in the cooling passage 56, so all the cooling water from the cooling passage 56 must flow to the cooling passages 80, 82 and then through the valves 58 and 59. Similar to the third embodiment, the valves 58 and 59 replace (i.e. perform the function of) the valve 60 shown in FIGS. 1 and 4, thus controlling discharge of the cooling water from the cooling passage 56 in the crankcase 28 via the noted cooling passages 80, 82 in the engine block 24 and engine heads 26. The valves 58 and 59 also control discharge of the cooling water from the engine block 24 and engine heads 26, which is combined together with the cooling water from the crankcase 28 in the cooling passages 80, 82 at a location upstream of the valves 58, 59, as shown.

Through further research and experimentation, the present inventors have determined that it can be advantageous to feed the cooling water first through the noted passages alongside the exhaust conduit, manifold, and lubricant cooler so as to preheat the cooling water prior to introducing the cooling water to the cooling passage in the crankcase, thereby reducing the likelihood of condensation in the crankcase. The present inventors have further determined that it is advantageous to configure the various conduits and passages so that the cooling passage in the crankcase is fully drained of the cooling water when the marine engine and/or pump is shut off and regardless of trim position of the marine engine. It is important to remove all the cooling water from the various conduits and passages so that the cooling water does not expand during freezing temperatures thus avoiding damage that is often caused by repeated freezing and thawing of the cooling water inside of the marine engine.

Figure 8:
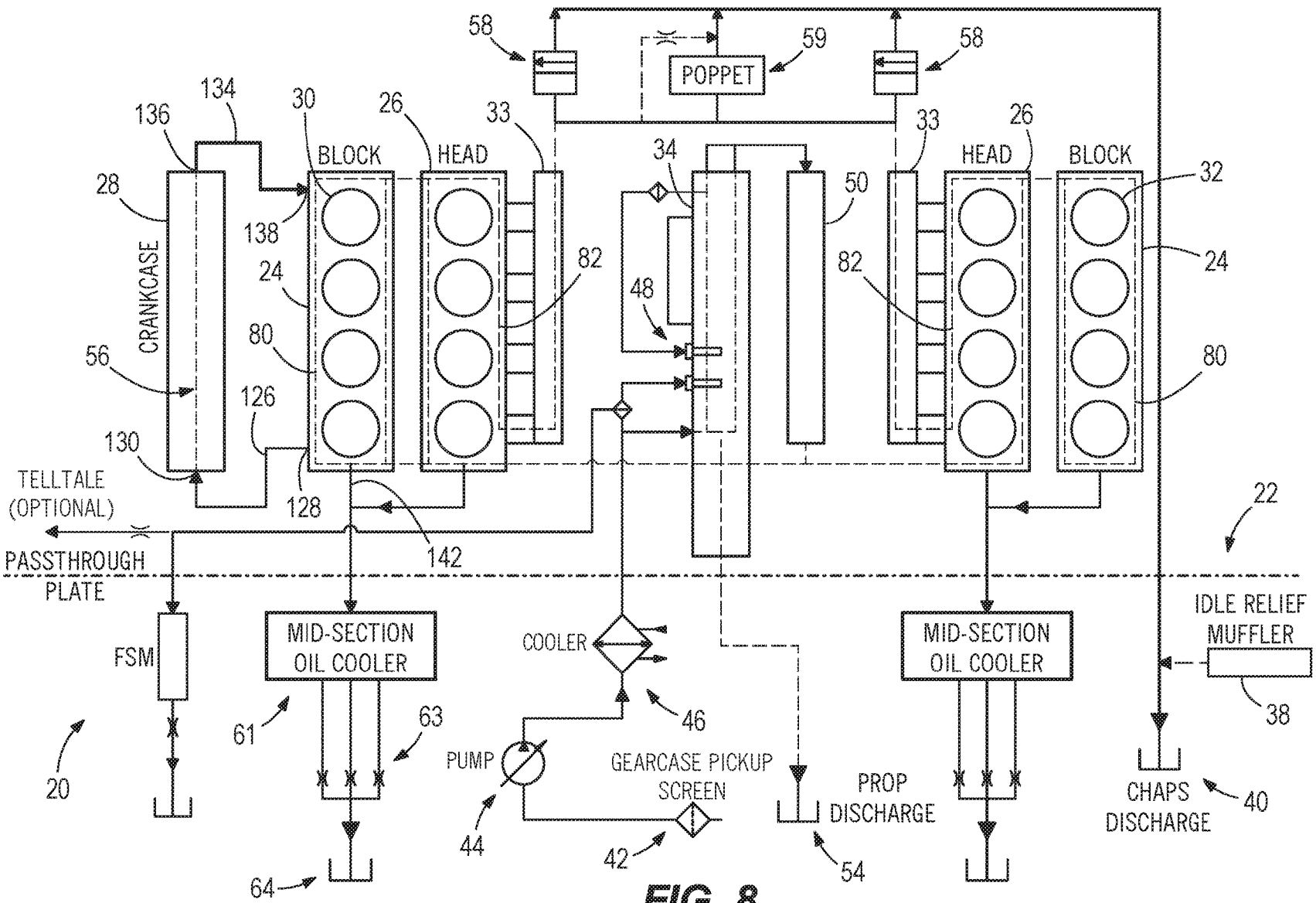
FIG. 8 is a schematic view of a sixth embodiment of the cooling system.

FIG. 8 schematically depicts a sixth embodiment that is similar to the fifth embodiment, however the cooling system 22 in the sixth embodiment first conveys the cooling water from the pump 44 through the transmission cooler 46, then through a cooling jacket on the exhaust conduit 34 from which it is sprayed into the exhaust gas conveyed through the exhaust conduit 34 via cooling water sprayers 48, all as is disclosed for example in U.S. Pat. No. 10,233,818. From the cooling jacket on the exhaust conduit 34, the cooling water is conveyed through the lubricant cooler 50 located in the noted valley of the marine engine 20, which particularly is located between the exhaust conduit 34 and the engine block 24, for example as disclosed in U.S. patent application Ser. No. 16/128,719. Then, from the lubricant cooler 50, the cooling water is conveyed to cooling passages 80, 82 in the engine heads 26 and engine block 24, for example as is disclosed U.S. Pat. No. 9,365,274. The cooling water is finally thereafter supplied to the cooling passage 56 in the crankcase 28. The cooling water is supplied from the cooling passage 56 in the crankcase 28 to the inlet side of the valves 58, 59, similar to the fifth embodiment, which as described above are mounted on the exhaust manifolds 33, via the cooling passages 80, 82 in the engine block 24 and engine heads 26. Note that there are no other outlets for the cooling water in the cooling passage 56, so all the cooling water from the cooling passage 56 must flow through the valves 58 and 59. Similar to the fifth embodiment, the valves 58 and 59 replace (i.e. perform the function of) the valve 60 shown in FIGS. 1 and 4, thus controlling discharge of the cooling water from the cooling passage 56 in the crankcase 28 via the noted cooling passages 80, 82 in the engine block 24 and engine heads 26. The valves 58 and 59 also control discharge of the cooling water from the engine block 24 and engine heads 26, which is combined together with the cooling water from the crankcase 28 in the cooling passages 80, 82. Thus the cooling water flows in parallel through the cooling passage 80 in the engine block 24 and the cooling passage 56 in the crankcase 28 prior to discharge via the valves 58, 59. In another example, the embodiment shown in FIG. 8 can include the valve 60 mounted on top of the crankcase 28, with all the functionality described herein above.

Figure 9:
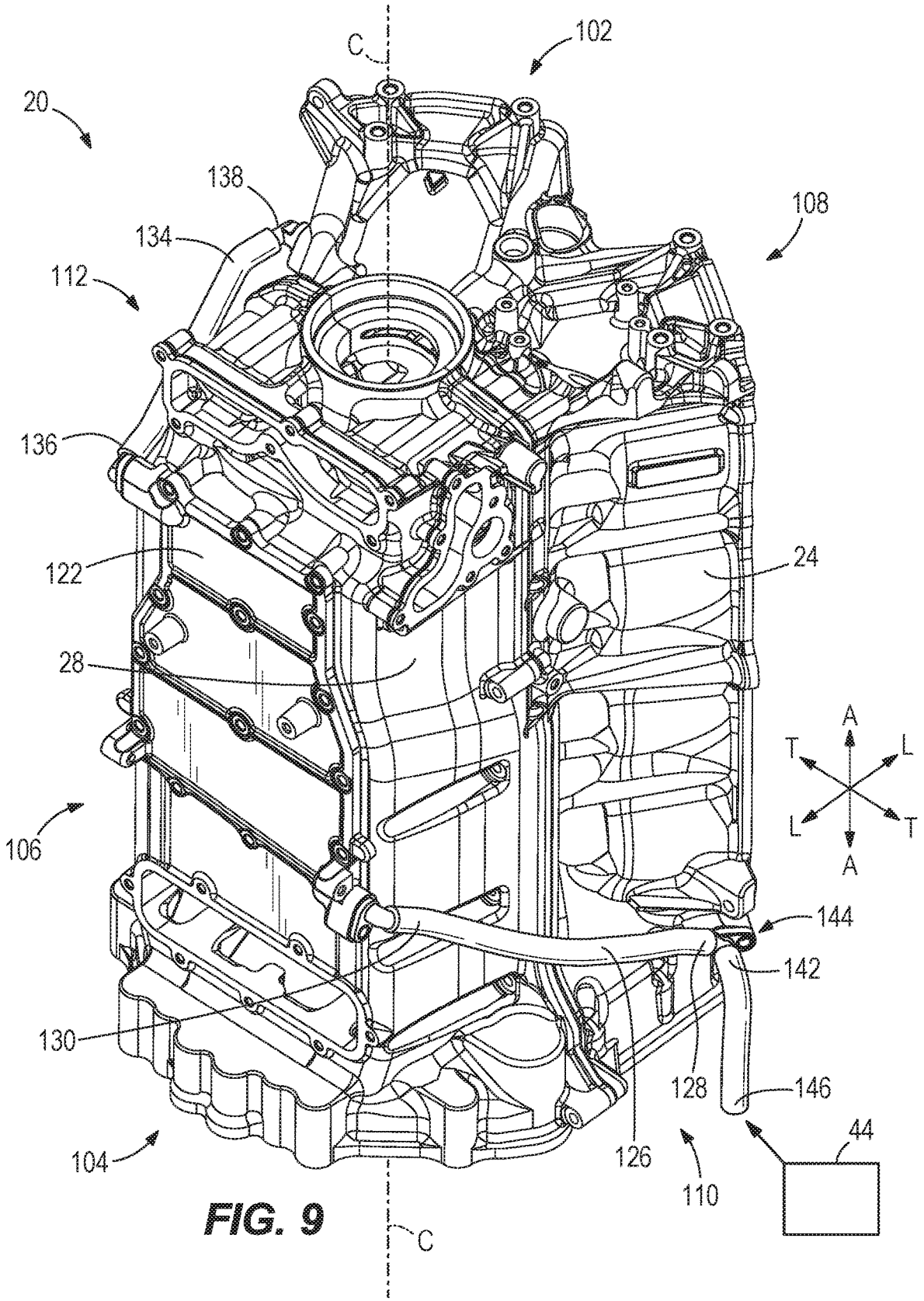
FIG. 9 is a perspective view of a marine engine according to the sixth embodiment, including a powerhead having an engine block, engine heads and a crankcase.
Figure 10:
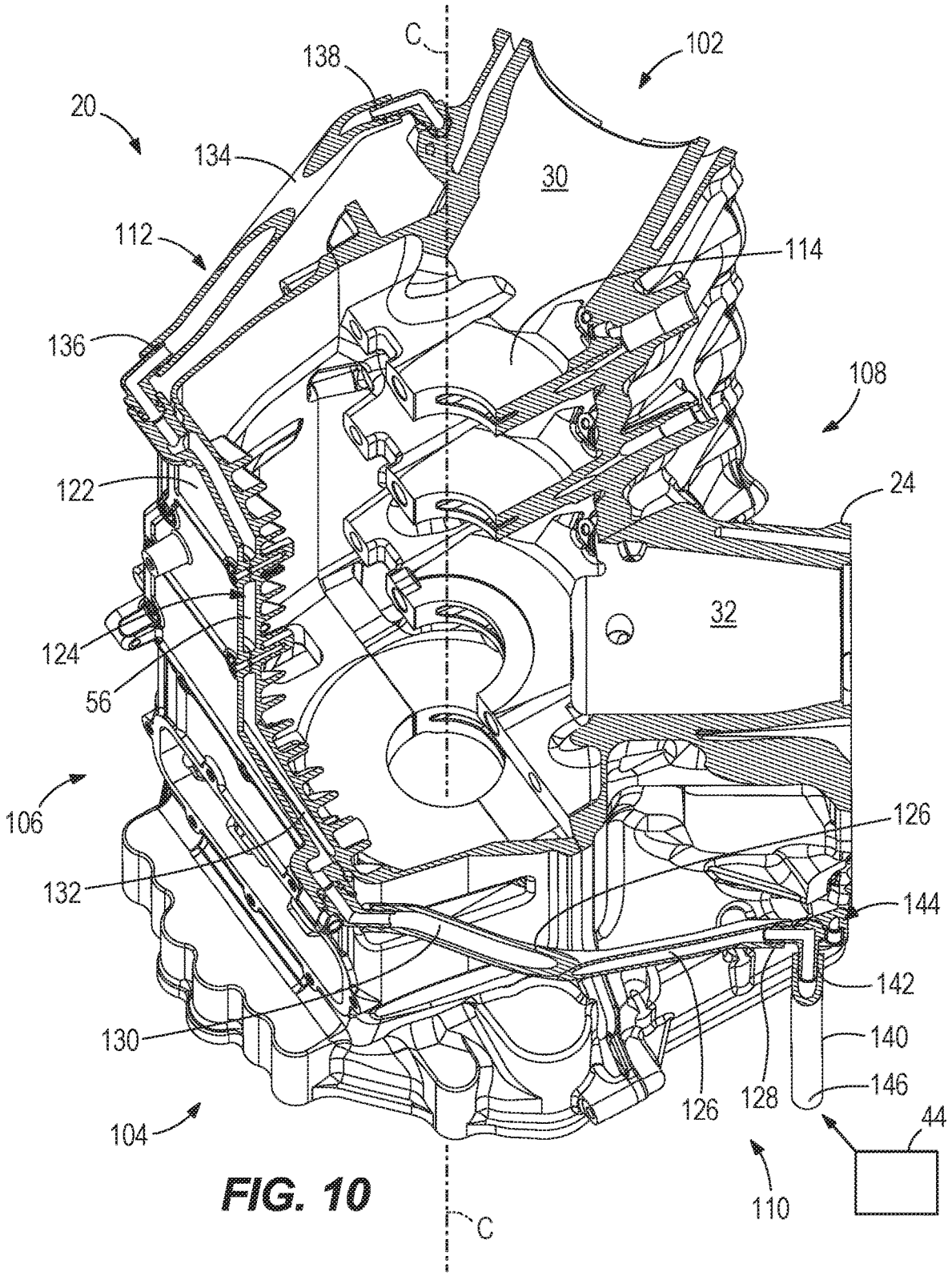
FIG. 10 is a sectional view of the marine engine shown in FIG. 9 in an upright position.

FIGS. 9 and 10 depict the sixth embodiment in more detail. The marine engine 20 extends from top side 102 to bottom side 104 in an axial direction A, from front side 106 to back side 108 in a longitudinal direction L that is perpendicular to the axial direction A, and from port side 110 to starboard 112 in a transverse direction T that is perpendicular to the axial direction A and perpendicular to the longitudinal direction L. As shown schematically in FIG. 8, the marine engine 20 includes a powerhead comprised of an engine block 24, an engine head 26 located rearwardly of the engine block 24. A crankcase 28 is located forwardly of the engine block 24. A crankshaft (not shown) is located in the crankcase 28 and is supported for rotation about a crankshaft axis C by a series of vertically aligned bearings 114 (FIG. 10) in the crankcase 28. The crankshaft axis C extends parallel to the noted axial direction A. Similar to the arrangement disclosed in U.S. Pat. No. 9,616,987, the engine block 24 has first and second banks of cylinders 30, 32 that are disposed along the crankshaft axis C and extend transversely with respect to each other in a V-shape so as to define a valley there between. The combustion process in the marine engine 20 causes rotation of the noted crankshaft, which in turn causes rotation of the corresponding driveshaft, a propeller shaft, and a propeller configured to propel an associated marine vessel in water, all as is conventional. The above-incorporated U.S. Pat. No. 9,616,987 discloses examples of type of arrangement in more detail.

Referring to FIG. 10, the cooling passage 56 conveys the cooling water through the crankcase 28 for cooling the crankcase 28 and the lubricant contained within the crankcase 28. The cooling passage 56 is defined by a cooling jacket 124 on a removable cover 122 of the crankcase 28. One example of this type of arrangement is disclosed in the above-incorporated U.S. Pat. No. 9,457,881. In the illustrated example, the cooling passage 56 is located forwardly of the crankshaft axis C. The mechanical or electric pump 44 (shown schematically in FIGS. 9-10) is configured to draw the cooling water into the outboard motor from the body of water in which the outboard motor is operated and pump the cooling water first through the engine block 24, all as described herein above. As described with reference to FIG. 8, the pump 44 conveys the cooling water first to the noted cooling passages 80, 82 in the engine block 24 and engine heads 26. In particular, with reference to FIGS. 9 and 10, the cooling water is conveyed from the cooling passages 80, 82 in the powerhead to the cooling passage 56 in the crankcase 28 via a first cooling water conduit 126. The first cooling water conduit 126 has a first end 128 that receives the cooling water from the cooling passages 80, 82 in the powerhead, and more particularly directly from the cooling passage 80 in the engine block 24. The first cooling water conduit 126 has a second end 130 that supplies the cooling water to the cooling passage 56 in the crankcase 28. As shown in FIG. 9, the first end 128 is located below the second end with respect to the axial direction A. The first end 128 is located rearward of the crankshaft axis C with respect to the longitudinal direction L. The second end 130 is located forwardly of the crankshaft axis C with respect to the longitudinal direction L.

Figure 11:
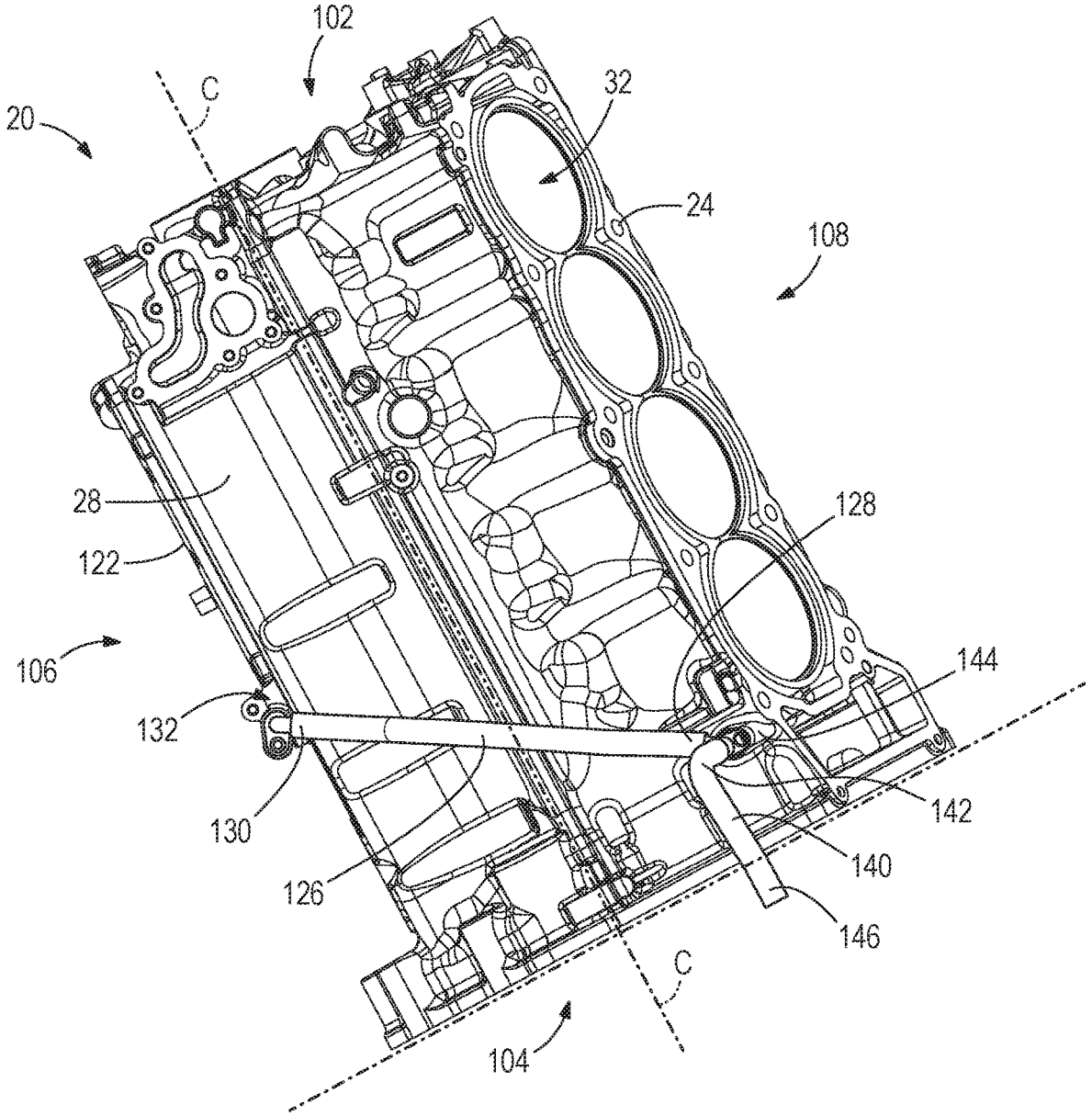
FIG. 11 is a sectional view of the marine engine shown in FIG. 9 in a fully trimmed-up position.

Advantageously, the first cooling water conduit 126 is configured to convey the cooling water from the engine block 24 to the cooling passage 56 when the pump 44 is operating and drain the cooling water from the cooling passage 56 when the pump 44 is not operating. In particular, the second end 130 of the first cooling water conduit 126 is located at a lower end 132 of the cooling jacket 124 with respect to the axial direction A and so as to drain the cooling water from the cooling passage 56 when the pump 44 is not operating. Thus the first cooling water conduit 126 is configured to fully drain the cooling water from the cooling passage 56 when the pump 44 is not operating, and even when the outboard motor is trimmed or tucked about a trim axis into a position wherein the crankshaft axis C is at a thirty degree angle from vertical, see FIGS. 11 and 12.

Figure 12:
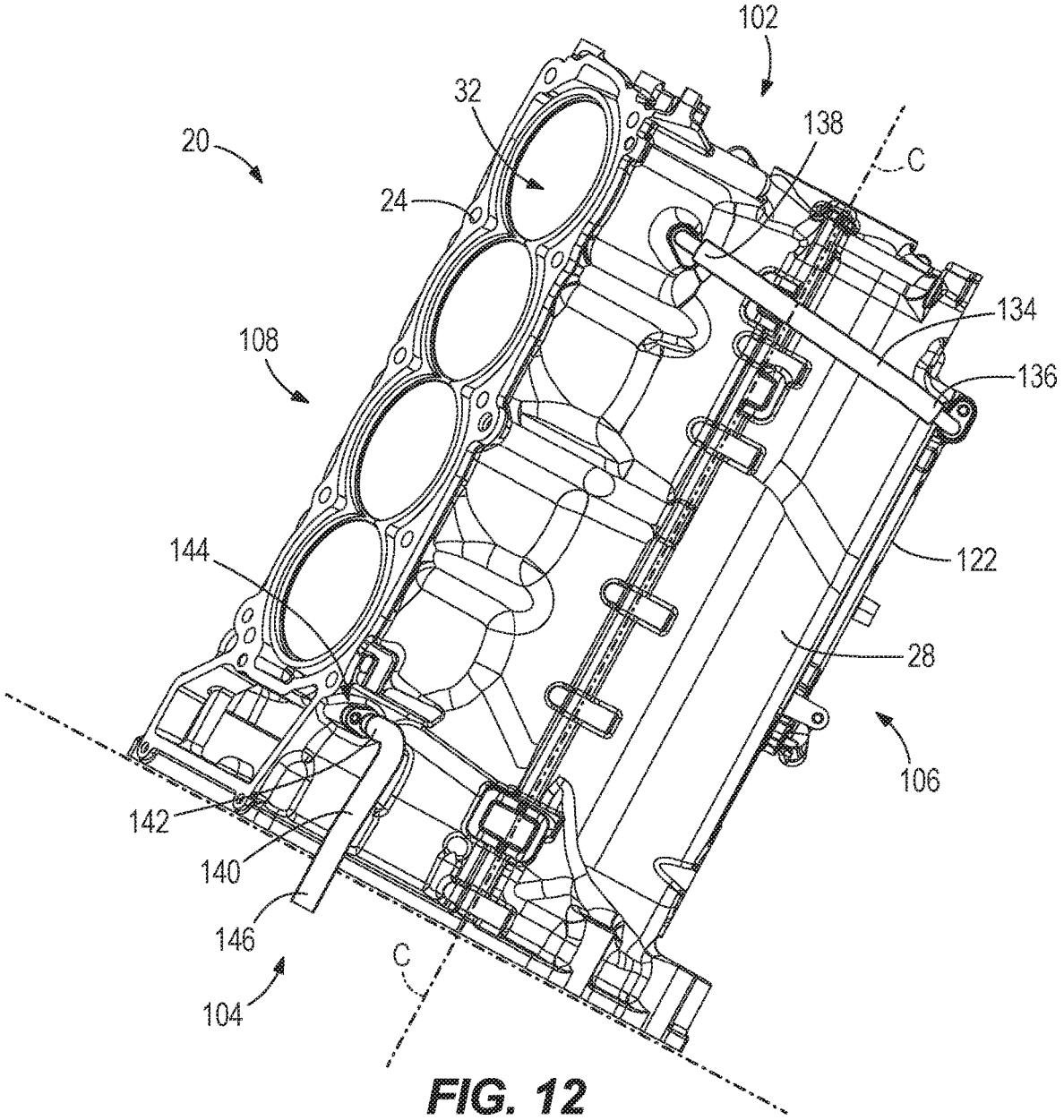
FIG. 12 is a sectional view of the marine engine shown in FIG. 9 in a fully trimmed-down position.

Referring to FIG. 12, a second cooling water conduit 134 conveys the cooling water from the cooling passage back to the engine block 24. The second cooling water conduit 134 has a first end 136 that receives the cooling water from the cooling passage 56 and a second end 138 that supplies the cooling water back to the cooling passage 80 in the engine block 24. The first end 136 of the second cooling water conduit 134 is located lower than the second end 138 with respect to the axial direction A and such that the second cooling water conduit 134 drains water from the cooling passage 80 in the engine block 24 when the pump 44 is not operating. In particular, the cooling water is drained from the cooling passage 80 to the second cooling water conduit 134, then to the cooling passage 56, then to the first cooling water conduit 126.

Referring to FIGS. 9-12, a third cooling water conduit 140 is configured to convey the cooling water to and from both of the cooling passage 80 in the engine block 24 and the cooling passage 56 in the crankcase 28. The third cooling water conduit 140 has a first end 142 connected to an inlet/outlet port 144 on the engine block 24, which is in fluid communication with both the cooling passage 80 on the engine block 24 and the first end 128 of the first cooling water conduit 126. The third cooling water conduit 140 has a second end 146 located lower than the first end 142 with respect to the axial direction A, such that the third cooling water conduit 140 drains the cooling water via gravity from both the first cooling water conduit 126 and the cooling passage 80 in the engine block 24 when the pump 44 is not operating, for example when the marine engine 20 is off and trimmed or tucked into a thirty degree angle from vertical, see FIGS. 11 and 12, and as described herein above.

In the present description, certain terms have been used for brevity, clearness and understanding. No unnecessary limitations are to be implied therefrom beyond the requirement of the prior art because such terms are used for descriptive purposes only and are intended to be broadly construed. The different systems described herein may be used alone or in combination with other systems. Various equivalents, alternatives and modifications are possible within the scope of the appended claims.

What is claimed is:

1. A marine engine comprising:

a powerhead, a crankcase on the powerhead and a crankshaft disposed in the crankcase, a cooling system that conveys cooling water to the crankcase and particularly through a cooling passage for cooling the crankcase, the cooling system comprising a pump that pumps the cooling water from a body of water in which the marine engine is operated through the cooling system and particularly through the cooling passage, and a valve that controls discharge of the cooling water from the cooling passage so as to reduce condensation of lubricant in the crankcase and condensation of lubricant in a lubricant sump for the marine engine, in particular wherein the valve is positionable in an open position in which the valve permits said discharge of the cooling water from the cooling passage, and wherein the valve is alternately positionable in a closed position in which the valve substantially prevents said discharge of the cooling water from the cooling passage, and wherein the valve in the open position permits said discharge of the cooling water from the cooling passage to a lubricant cooler for cooling the lubricant sump, and wherein the valve in the closed position substantially prevents said discharge of the cooling water from the cooling passage to the lubricant cooler.

2. The marine engine according to claim 1, further comprising a cooling jacket on the crankcase, the cooling jacket defining the cooling passage.

3. The marine engine according to claim 1, wherein the valve comprises a thermostat.

4. The marine engine according to claim 3, wherein the thermostat is configured to purge air from the cooling system.

5. The marine engine according to claim 3, wherein the thermostat automatically prevents and automatically allows said discharge of the cooling water from the cooling passage based on temperature of the cooling water.

6. The marine engine according to claim 3, further comprising a controller that controls opening and closing of the thermostat based upon input from a temperature sensor associated with the marine engine.

7. The marine engine according to claim 6, wherein the temperature sensor provides the input based upon temperature of at least one of temperature of the cooling water, temperature of engine lubricant, and temperature of exhaust gas discharged from the marine engine.

8. The marine engine according to claim 1, wherein the valve comprises a mechanical valve that opens and closes based upon pressure of the cooling water in the cooling system.

9. The marine engine according to claim 1, wherein the valve is mounted on the crankcase.

10. The marine engine according to claim 1,, wherein the powerhead comprises an engine block and an engine head.

11. The marine engine according to claim 10, wherein the valve is mounted on the powerhead.

12. The marine engine according to claim 11, further comprising an exhaust manifold that discharges exhaust gas from the marine engine and wherein the valve is mounted on the exhaust manifold.

13. The marine engine according to claim 10, wherein the cooling water is conveyed from the pump to the cooling passage without being first provided to the powerhead.

14. The marine engine according to claim 10, wherein the cooling water is conveyed from the pump to the engine block and then to the cooling passage.

15. The marine engine according to claim 10, wherein the cooling water is conveyed in parallel through the cooling passage and the engine block.

16. The marine engine according to claim 10, wherein the cooling water is conveyed from the cooling passage to the engine block.

17. The marine engine according to claim 16, wherein the valve is configured to control said discharge of the cooling water from the cooling passage and cooling water from the engine block.

18. The marine engine according to claim 1, further comprising an auxiliary component mounted on the crankcase so as to exchange heat with the cooling water in the cooling passage.

19. The marine engine according to claim 18, wherein the auxiliary component is selected from a group consisting of a fuel cooler, a power steering fluid controller, a transmission fluid cooler, an engine control module, a trim relay module and a power steering module.

* * * * *